US006863623B2

(12) United States Patent
Oyama

(10) Patent No.: US 6,863,623 B2
(45) Date of Patent: Mar. 8, 2005

(54) GOLF CLUB SHAFT

(75) Inventor: Hitoshi Oyama, Hyogo (JP)

(73) Assignee: Sumitomo Rubber Industries, Ltd., Kobe (JP)

( * ) Notice: Subject to any disclaimer, the term of this patent is extended or adjusted under 35 U.S.C. 154(b) by 0 days.

(21) Appl. No.: 10/307,325

(22) Filed: Dec. 2, 2002

(65) Prior Publication Data

US 2003/0125125 A1 Jul. 3, 2003

(30) Foreign Application Priority Data

Dec. 25, 2001 (JP) ..... 2001-391356

(51) Int. Cl.[7] ..... A63B 53/10; A63B 53/12
(52) U.S. Cl. ..... 473/319; 473/321
(58) Field of Search ..... 473/316–323; 428/36.3, 36.9; 264/135; 156/187, 188

(56) References Cited

U.S. PATENT DOCUMENTS 5,776,008 A * 7/1998 Lundberg ..... 473/320
2003/0114241 A1 * 6/2003 Oldenburg ..... 473/323

FOREIGN PATENT DOCUMENTS

JP 2-98375 * 4/1990
JP 08-224809 A 9/1996
JP 2001-062015 A 3/2001

* cited by examiner

*Primary Examiner*—Stephen Blau
(74) *Attorney, Agent, or Firm*—Birch, Stewart, Kolasch & Birch, LLP

(57) ABSTRACT

A golf club shaft formed by winding prepregs of an angular layer and those of a straight layer around a mandrel (10) having a steeply tapered part (10B) formed at a tip side thereof and a gently tapered part (10C) formed, at a butt side thereof, continuously with the steeply tapered part (10B). Prepregs (17, 18) of the angular layer are disposed at the tip side of the mandrel (10). Butt-side ends (17*a,* 18*a*) of the prepregs (17, 18) of the angular reinforcing layer at the tip side of the mandrel (10) are disposed at the butt side of the mandrel (10) with respect to a boundary position (P2) disposed at a boundary between the steeply tapered part (10B) and the gently tapered part (10C). A distance from the butt-side ends (17*a,* 18*a*) of the prepregs (17, 18) of the angular reinforcing layer at the tip side of the mandrel (10) to the boundary position (P2) is not less than 5% nor more than 30% of a whole length of the shaft.

11 Claims, 6 Drawing Sheets

GOLF CLUB SHAFT

This Nonprovisional application claims priority under 35 U.S.C. & 119(a) on patent application No. 2001-391356 filed in Japan on Dec. 25, 2001, which is herein incorporated by reference.

BACKGROUND OF THE INVENTION

1. Field of the Invention

The present invention relates to a golf club shaft and more particularly to a golf club shaft, made of a fiber reinforced resin, which is lightweight and improved in its strength and stability of the direction of a hit golf ball.

2. Description of the Related Art

The performance demanded for the golf club is to hit golf balls a long distance and make the direction thereof stabilized. As one means for complying with the demand of hitting the golf ball a long distance, research for making the shaft lightweight is performed. That is, by making the shaft lightweight, the golf club can be swung easily and the head speed thereof increases. Thus it is possible to make the flight distance of the golf ball longer.

As one means for complying with the demand of stabilizing the direction of the hit golf ball, research for suppressing easiness of twisting (decrease of torque) of the shaft is made. That is, by suppressing the twisting of the shaft, it is possible to reduce a deviation of the flight direction of the golf ball which occurs owing to a deflection of the face of the golf club at the time of an impact of the golf ball on the face. Thus it is possible to stabilize the direction of the hit golf ball.

To reduce the torque, in the golf club shaft made of the fiber reinforced resin, the amount of prepregs of an angular layer whose reinforcing fibers are oblique to the axial direction of the shaft is increased or reinforcing fibers having a high tensile modulus of elasticity are used. However, to increase the amount of the prepregs of the angular layer leads to an increase of the weight of the shaft, which prevents the intention of making the shaft lightweight. Because a material having a high tensile modulus of elasticity has a low strength, the shaft is liable to be broken.

To solve the problems, many proposals for making the shaft lightweight and reducing the torque are made. For example, the pipe composed of layered fiber reinforced resins and the golf club shaft are disclosed in Japanese Patent Application Laid-Open No. 8-224809 and No. 2001-62015 respectively. In these proposals, separately from the angular layer formed on the whole length of the conventional shaft made of the fiber reinforced resin, the angular layer is partly formed at only the tip side of the shaft.

However, in the pipe disclosed in Japanese Patent Application Laid-Open No. 8-224809, the outer diameter of the tip of the shaft becomes large because the reinforcing bias layers are disposed at the tip side of the shaft in dependence on the relationship between the mandrel. Thus the pipe has a problem that it is difficult to make the shaft lightweight and a problem that the rigidity at the tip side of the shaft becomes too high. Further if the outer diameter of the tip of the shaft is kept at the conventional diameter (ϕ8.5 mm–9.5 mm), a sufficient thickness cannot be obtained. Thus a sufficient strength cannot be obtained and thus the shaft is liable to be broken. Another problem is that in the case where a material having a tensile modulus of elasticity not less than 50 ton/mm$^2$ is used to compose the reinforcing layer, the shaft is liable to be broken since the strength of the material is low.

In Japanese Patent Application Laid-Open No. 2001-62015, there is disclosed a method of changing the tapering ratio of the mandrel and layering the angular reinforcing layers one upon another, with ends of the angular reinforcing layers coinciding with the boundary between adjacent tapered parts having different tapering ratios. More specifically, the ends of the angular reinforcing layers coincide with the portion at which the tapering ratio of the mandrel changes greatly from the main tapered part having a large tapering ratio to the gently tapered part having a small tapering ratio. Therefore a stress concentrates on the portion at which the tapering ratio of the mandrel changes greatly and the shaft is liable to be broken.

SUMMARY OF THE INVENTION

The present invention has been made in view of the above-described problems. Therefore it is an object of the present invention to provide a golf club shaft lightweight to lengthen the flight distance of a golf ball hit with a golf club using the golf club shaft, having a low torque to stabilize the direction of the hit golf ball, and having such a high strength that it is not broken.

To achieve the object, according to the present invention, there is provided a golf club shaft formed by winding prepregs of an angular layer and those of a straight layer around a mandrel having a steeply tapered part formed at a tip side thereof and a gently tapered part formed, at a butt side thereof, continuously with the steeply tapered part.

The prepregs are made of matrix resin and reinforcing fibers. In the golf club shaft, at least one of the prepregs of the angular layer is disposed at the tip side of the mandrel; and a butt-side end of the prepreg of the angular reinforcing layer at the tip side of the mandrel is disposed at the butt side of the mandrel with respect to a boundary position disposed at a boundary between the steeply tapered part and the gently tapered part. A distance from the butt-side end of the prepreg of the angular reinforcing layer at the tip side of the mandrel to the boundary position is not less than 5% nor more than 30% of a whole length of the shaft.

As a result of their energetic research, the present inventors have found out that it is possible to make the shaft lightweight and its strength high by forming a steep inclined part having a high tapering ratio at the tip side (head-mounting side) of the mandrel and increasing the thickness of the tip side of a golf club shaft to which a largest load is applied when a golf ball is hit. They have also found that the golf club shaft is allowed to be lightweight and have a low torque by appropriately disposing the prepregs of the angular layers at the tapered tip side of the mandrel. Therefore by layering the prepregs of the angular layers at the tip side of the mandrel in consideration of the relationship between the mandrel and the prepregs of the angular layers, it is possible to provide the golf club shaft having a light weight to lengthen the flight distance of the hit golf ball, a low torque to stabilize the direction of the hit golf ball, and further such a high strength that it is not broken.

More specifically, according to the present invention, in addition to disposition of the angular layer whose reinforcing fibers incline with respect to the axial direction of the shaft over the whole length of the shaft and disposition of the straight layer whose reinforcing fibers are parallel with the axial direction of the shaft over the whole length thereof, the prepregs of the angular layers realizing a low torque are layered one upon another at the tip side of the shaft which is smallest in its outer diameter and thus most twistable of all parts of the shaft. Thereby it is possible to efficiently make the shaft lightweight and realize a low torque.

In winding the prepregs around the mandrel, it is preferable that the butt-side end of the prepreg of the angular reinforcing layer at the tip side of the mandrel is disposed at the butt side of the mandrel with respect to the boundary position disposed at the boundary between the steeply tapered part and the gently tapered part. The distance from the butt-side end of the prepreg of the angular reinforcing layer at the tip side of the mandrel to the boundary position is not less than 5% nor more than 30% of a whole length of the shaft and favorably not less than 5% nor more than 20% of the whole length of the shaft. By dislocating the end of each of the angular reinforcing layers from the boundary position of the mandrel, with each of the angular reinforcing layers covering the steeply tapered part, it is possible to soften the change in the thickness of the shaft at a position thereof corresponding to the boundary position of the mandrel and prevent the shaft from being broken by concentration of a stress.

If the above-described distance is less than 5% of the whole length of the shaft, the operation of softening the change in the thickness of the shaft is performed in a low extent. Thus the shaft is liable to be broken. If the distance is more than 30%, an extra weight is required to be added to the shaft to realize a low torque. Thus a lightweight shaft cannot be obtained.

To obtain the effect of the present invention, the length of the prepreg of each angular reinforcing layer at the tip side of the mandrel is favorably less than 55% of the whole length of the shaft and more favorably less than 40% of the whole length thereof. It is preferable to layer the prepregs on the mandrel one upon another in such a way that the tip-side end of the prepreg of each angular reinforcing layer at the tip side of the mandrel is coincident with the tip of the shaft, but may be shifted a little toward the butt side of the shaft. That is, the tip-side end of the prepreg may not be disposed in a portion which is disposed in the hosel when the head is installed on the shaft.

It is preferable that the tapering ratio (inclination ratio) of the steeply tapered part is not less than 15/1000 nor more than 35/1000.

If the tapering ratio of the steeply tapered part is less than 15/1000, a sufficient thickness cannot be obtained at the tip side of the shaft. Thus the shaft is liable to be broken. On the other hand, if the tapering ratio of the steeply tapered part is more than 35/1000, workability in a molding operation is low, and further the shaft is liable to be broken owing to a stress concentration caused by a big change in the tapering ratio of the mandrel at the boundary between the gently tapered part and the steeply tapered part.

It is preferable that the tapering ratio (inclination ratio) of the gently tapered part is not less than 6/1000 nor more than 10/1000. If the tapering ratio of the gently tapered part is out of the above range, the outer diameter of the tip side of the shaft or its butt side is so large or so small that the shaft is unfittable on a conventional head or grip.

It is preferable that in winding the prepregs on the mandrel, the distance from the boundary position (butt-side end of steeply tapered part) between the steeply tapered part and the gently tapered part to the position corresponding to the tip of the shaft is not less than 10% nor more than 25% of the whole length of the shaft. Thereby it is possible to efficiently make the shaft lightweight and provide the shaft with a sufficient strength.

If the above-described distance is more than 25%, the strength of the shaft at its tip side is insufficient and thus the shaft is liable to be broken. If the distance is less than 10%, the shaft is so heavy that it is difficult to produce the lightweight shaft.

The fibrous angle of reinforcing fibers of the prepregs of the angular reinforcing layer disposed at the tip side of the mandrel is set to not less than 20 degrees nor more than 70 degrees and favorably not less than 30 degrees nor more than 55 degrees. The optimum angle is 45 degrees.

If the fibrous angle is less than 20 degrees, it is difficult to obtain a torque-decreasing effect. On the other hand, if the fibrous angle is more than 70 degrees, it is impossible to obtain the torque-decreasing effect, and the shaft has a low strength and is liable to be broken.

It is preferable that the tensile breaking strain of the prepregs of the angular reinforcing layer disposed at the tip side of the mandrel is set to not less than 1.0%.

If the tensile breaking strain is less than 1.0%, even a small deformation of the prepregs will cause the shaft to be broken. Thus the prepregs are demanded to be flexible and unsuitable for the reinforcing material of the shaft at its tip side susceptible to a greatest impact when a golf ball is hit. It is difficult to obtain the material having a tensile breaking strain more than 3.0%. Thus it is preferable that the tensile breaking strain is less than 3.0%.

It is preferable to use a mandrel having a tip-side gently tapered part having a tapering ratio lower than that of the steeply tapered part formed at a tip side thereof with respect to the steeply tapered part. By forming the tip-side gently tapered part having a tapering ratio lower than that of the steeply tapered part at the tip side thereof with respect to the steeply tapered part, the shaft does not have an excessive thickness and weight in the neighborhood of its tip. Thereby it is possible to make the shaft lightweight and improve its strength.

It is preferable that the diameter of the mandrel at the position thereof corresponding to the tip of the shaft, namely, the inner diameter of the shaft at its tip is not less than 3.0 mm nor more than 6.5 mm.

If the diameter of the mandrel at the position thereof corresponding to the tip of the shaft is less than 3.0 mm, the workability in winding the prepregs around the mandrel is low, and it is difficult to make the shaft lightweight. If the diameter of the mandrel at the position thereof corresponding to the tip of the shaft is more than 6.5 mm, the reinforcing effect is low and it is difficult to provide the shaft with a rigidity and a strength in a required degree.

It is preferable that the outer diameter of the tip of the shaft is not less than 8.0 mm nor more than 12.0 mm.

If the outer diameter of the tip of the shaft is less than 8.0 mm, it is difficult to obtain a required degree of rigidity and strength. On the other hand, if the outer diameter of the tip of the shaft is more than 12.0 mm, a player feels unusual and it is difficult to make the shaft lightweight and the rigidity of the shaft at its tip side is so high that it is difficult for a golfer to obtain a good feeling.

It is preferable that the diameter of the mandrel at the boundary position between the steeply tapered part and the gently tapered part is not less than 4.0 mm nor more than 11.5 mm.

If the diameter of the mandrel at the boundary position is less than 4.0 mm, the steeply tapered part is short and narrow. Consequently it is difficult to obtain the effect of the reinforcing the tip side of the shaft and a preferable outer diameter at the tip and butt of the shaft. On the other hand, if the diameter of the mandrel at the boundary position is more than 11.5 mm, the entire shaft is so thick that it is difficult to obtain a preferable outer diameter at the tip and butt of the shaft.

It is preferable that the diameter of the mandrel at the position thereof corresponding to the butt of the shaft is not less than 12.0 mm nor more than 16.0 mm.

If the diameter of the mandrel at the position thereof corresponding to the butt of the shaft is less than 12.0 mm, the shaft is so narrow that it is difficult to provide the shaft with a proper degree of rigidity, and it is necessary to make the grip thick to allow the grip to have a desired thickness. Consequently a golf club composed of the shaft is heavy and it is difficult to swing it. On the other hand, if the diameter of the mandrel at the position thereof corresponding to the butt of the shaft is more than 16.0 mm, the shaft is so thick that it is difficult to swing the golf club.

The weight of the shaft per unit length is not less than $3.5\times10^{-2}$ g/mm nor more than $5.0\times10^{-2}$ g/mm and favorably not less than $3.8\times10^{-2}$ g/mm nor more than $4.8\times10^{-2}$ g/mm.

If the weight of the shaft is less than $3.5\times10^{-2}$ g/mM, it is difficult for a material used ordinarily to provide the shaft with a required degree of rigidity and strength. Thus the degree of freedom in designing the shaft is very low. That is, it is difficult for the shaft to have a required degree of rigidity and strength and give a good feeling to a golfer. If the weight of the shaft per unit length is more than $5.0\times10^{-2}$ g/mm, the degree of freedom in designing the shaft is so high that it is difficult to obtain the effect of reinforcing the tip side of the shaft.

It is preferable that the torque value of the shaft is not less than 3.0 degrees nor more than 5.0 degrees.

If the torque value of the shaft is less than 3.0 degrees, the golfer feels hard when the user hits a golf ball with the golf club and it is difficult to fly the golf ball high. On the other hand, if the torque value of the shaft is more than 5.0 degrees, there is a large variation in the flight direction of the hit golf ball. That is, it is difficult to satisfy the golfer's demand. The torque value of the shaft is measured by a method which will be described later.

It is preferable that the tapering ratio of the outer diameter of the shaft is less than 10/1000. If the tapering ratio of the outer diameter of the shaft is more than 10/1000, it is difficult to obtain a preferable outer diameter of the tip and butt of the shaft and there is little difference between the tapering ratio of the steeply tapered part at the tip side and that of the outer diameter of the shaft. In this case, the shaft has the effect of the present invention in a low extent. Further the shaft is so flexible at its tip side that the flight direction of a hit golf ball is liable to be nonuniform.

The total weight of the prepregs of the angular reinforcing layer disposed at the tip side of the mandrel is set to not less than 11.0 g nor more than 5.09 and favorably not less than 2.09 nor more than 4.5 g.

If the total weight of the prepregs of the angular reinforcing layer disposed at the tip side of the mandrel is set to less than 11.0 g, it is impossible to obtain a sufficient reinforcing effect and it is difficult to obtain a required degree of rigidity and strength. If the total weight of the prepregs of the angular reinforcing layer disposed at the tip side of the mandrel is more than 5.0 g, it is difficult to make the shaft lightweight.

It is preferable that the tensile modulus of elasticity of reinforcing fibers of the prepregs of the angular reinforcing layer disposed at the tip side of the mandrel is not less than 230 Gpa nor more than 400 Gpa. Thereby it is possible to realize a low torque while the shaft has a required strength.

It is preferable that the shaft of the present invention is formed of only the angular layer and the straight layer. However, the shaft may contain prepregs of a hoop layer whose fibers incline at 90 degrees with respect to the axis of the shaft.

As the resin which is used as the fiber reinforced resin composing the prepreg, thermosetting resin and thermoplastic resin can be used. The thermosetting resin and the thermoplastic resin can be used singly or in combination. In consideration of strength and rigidity, the thermosetting resin is preferable. Epoxy resin is particularly favorable.

As the thermosetting resin, the following resins can be used: unsaturated polyester resin, phenol resin, melamine resin, urea resin, diallyl phthalate resin, polyurethane resin, polyimide resin, and silicon resin. As the thermoplastic resin, the following resins can be used: polyamide resin, saturated polyester resin, polycarbonate resin, ABS resin, polyvinyl chloride resin, polyacetal resin, polystyrene resin, polyethylene resin, polyvinyl acetate resin, AS resin, methacrylate resin, polypropylene resin, and fluorine resin.

As the reinforcing fiber which is used for the fiber reinforced resin, the following fibers which are used as high-performance reinforcing fibers can be used: carbon fiber, graphite fiber, aramid fiber, silicon carbide fiber, alumina fiber; boron fiber, glass fiber, aromatic polyamide fiber, aromatic polyester fiber, and ultra-high-molecular-weight polyethylene fiber. Metal fibers can be used. The carbon fiber is preferable because it is lightweight and high in its strength. These reinforcing fibers are used in the form of long fibers or short fibers. It is possible to use a mixture of two or more of these fibers. The configuration and arrangement of the reinforcing fibers are not limited to specific ones. For example, they can be used in a single direction and a random direction; and in the form of a sheet, a mat, cloth, and a braid.

The golf club shaft of the present invention is applicable to all kinds of golf clubs. For example, a wooden head or an iron head can be mounted on the golf club shaft of the present invention.

DETAILED DESCRIPTION OF THE PREFERRED EMBODIMENTS

The embodiments of the present invention will be described below with reference to drawings.

Figure 1:
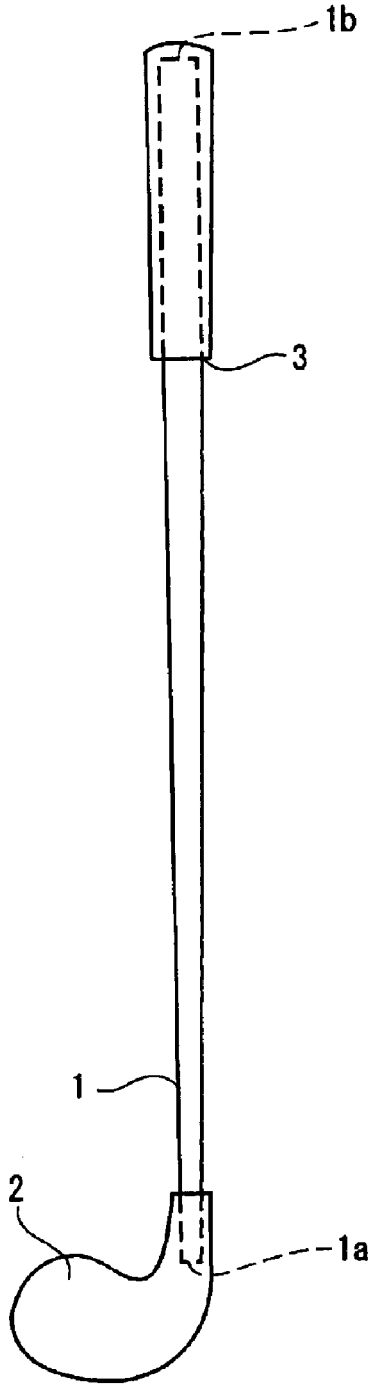
FIG. 1 is a schematic view showing a golf club using a golf club shaft of the present invention.

FIG. 1 shows a golf club shaft (hereinafter referred to as merely shaft) according to a first embodiment of the present invention. A shaft 1 is composed of a laminate of prepregs layered one upon another and has a shape of a hollow pipe. A head 2 is installed on the shaft 1 at one end (tip) 1*a* thereof having a smaller diameter. A grip 3 is installed on the shaft 1 at the other end (butt) 1*b* thereof having a larger diameter.

The length of the shaft 1 is set to 1143 mm. The weight of the shaft 1 is set to 51 g. The outer diameter of the shaft 1 at its tip 1*a* is set to 9.0 mm. The outer diameter of the shaft 1 at its butt 1*b* is set to 15.7 mm. A torque is set to 4.0 degrees.

Figure 2:
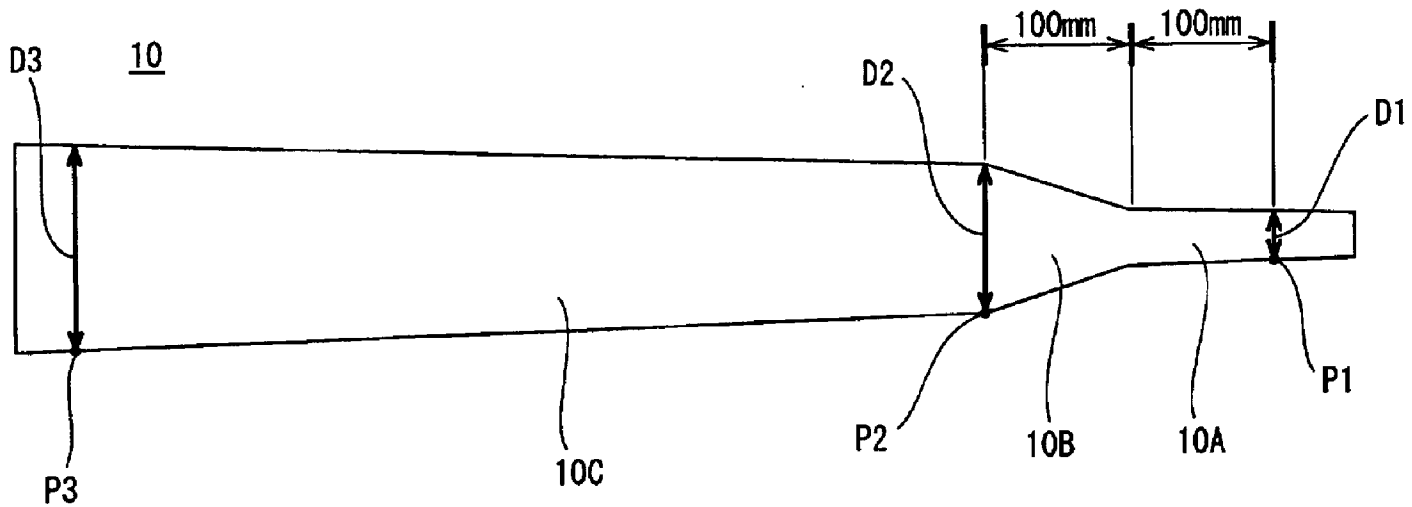
FIG. 2 shows a mandrel to be used to manufacture of the golf club shaft of the present invention.

FIG. 2 shows a mandrel 10 to be used to produce the golf club shaft according to the first embodiment of the present invention. The mandrel 10 has a tip-side gently tapered part 10A having a gentle tapering ratio of 8/1000 in the axial direction of the shaft 1, a steeply tapered part 10B continuous with the tip-side gently tapered part 10A and having a steep tapering ratio of 25/1000 in the axial direction thereof, and a gently tapered part 10C continuous with the steeply tapered part 10B and having a gentle tapering ratio of 8/1000 in the axial direction thereof. In winding the prepregs around the mandrel 10, the diameter D1 of the mandrel 10 at a position P1 corresponding to the tip 1*a* of the shaft 1 is set to 4.4 mm. The diameter D2 of the mandrel 10 at a position P2 disposed at the boundary between the steeply tapered part 10B and the gently tapered part 10C is set to 7.7 mm. The diameter D3 of the mandrel 10 at a position P3 corresponding to the butt 1*b* of the shaft 1 is set to 14.2 mm.

The tip-side gently tapered part 10A extends in a length of 100 mm from the position P1 corresponding to the tip 1*a* of the shaft 1. The steeply tapered part 10B extends in a length of 100 mm from the butt-side termination of the tip-side gently tapered part 10A. The gently tapered part 10C extends from the butt-side termination of the steeply tapered part 10B to the position P3 corresponding to the butt 1*b* of the shaft 1. The distance from the position P2 disposed at the boundary between the steeply tapered part 10B and the gently tapered part 10C to the position P1 corresponding to the tip 1*a* of the shaft 1 is 200 mm which is about 17.5% of the whole length of the shaft 1. The mandrel 10 is longer than the whole length of the shaft 1: the mandrel 10 extends to the tip side beyond the position P1 and to the butt side beyond the position P3.

Figure 3:
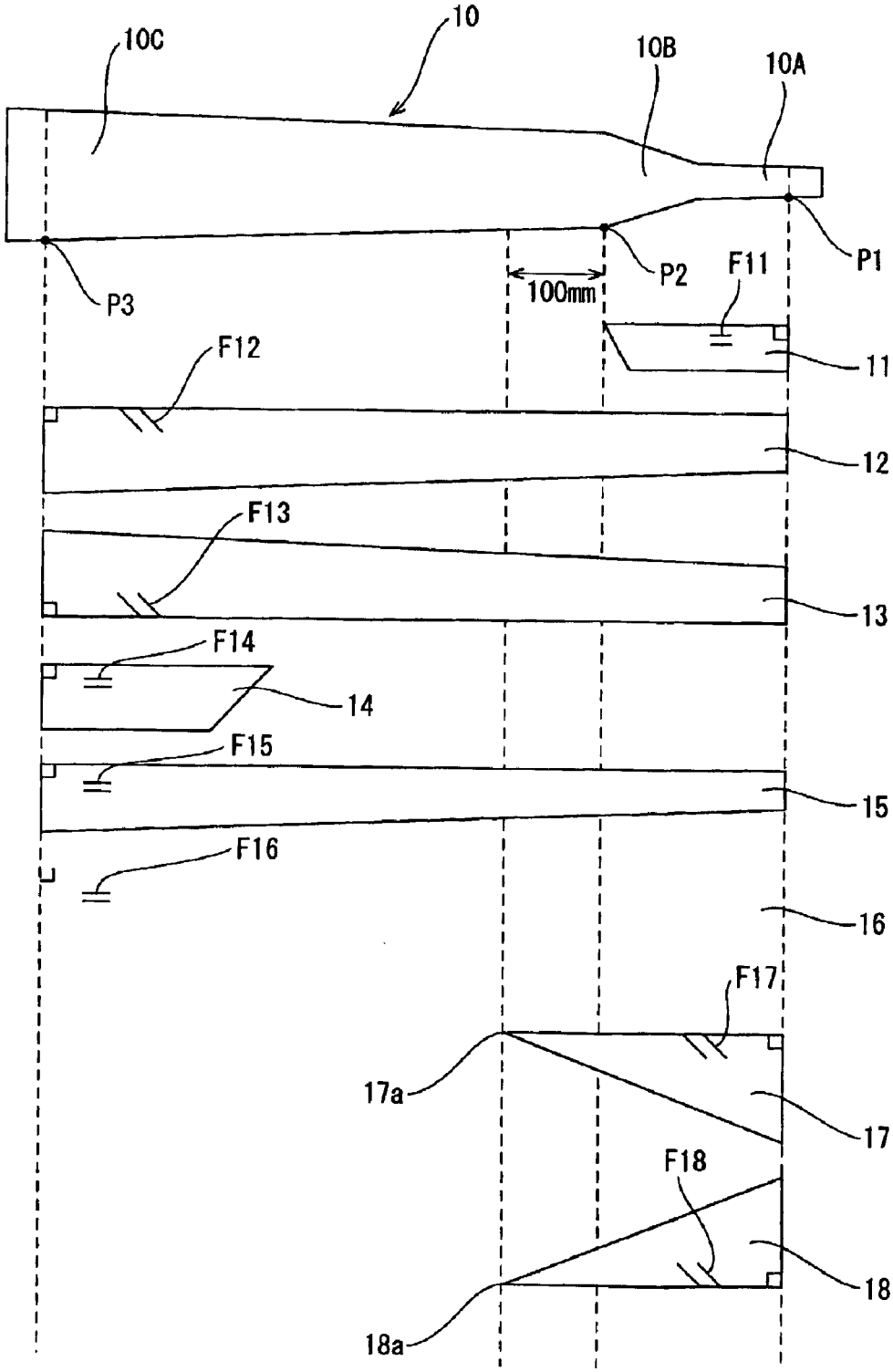
FIG. 3 shows the mandrel and a lamination structure of prepregs.

FIG. 3 shows the mandrel 10 and the lamination structure of the prepregs 11 through 18 to be wound around the mandrel 10.

In the prepreg 11, a reinforcing fiber F11 forms a fibrous angle of 0° (straight layer) with the axis of the shaft 1. The prepreg 11 is disposed at the tip side of the mandrel. The mandrel 10 is wound with five turns of the prepreg 11. The length of the prepreg 11 is set to 200 mm.

In the prepregs 12 and 13, a reinforcing fiber F12 of the prepreg 12 and a reinforcing fiber F13 of the prepreg 13 form a fibrous angle of +45° and −45° (angular layer) with the axis of the shaft 1. The prepregs 12 and 13 are disposed over the whole length of the shaft 1. The mandrel 10 is wound with three turns of the prepregs 12 and 13 at the tip side and two turns thereof at the butt side (change continuously). The length of each of the prepregs 12 and 13 is set to 1143 mm.

In the prepreg 14, a reinforcing fiber F14 forms a fibrous angle of 0° with the axis of the shaft 1. The prepreg 14 is disposed at the butt side of the mandrel 10. The mandrel 10 is wound with one turn of the prepreg 14. The length of the prepreg 14 is set to 350 mm.

In the prepreg 15, a reinforcing fiber F15 forms a fibrous angle of 0° with the axis of the shaft 1. The prepreg 15 is disposed over the whole length of the shaft 1. The mandrel 10 is wound with one turn of the prepreg 15. The length of the prepreg 15 is set to 1143 mm.

In the prepreg 16, a reinforcing fiber F16 forms a fibrous angle of 0° with the axis of the shaft 1. The prepreg 16 is disposed over the whole length of the shaft 1. The mandrel 10 is wound with two turns of the prepreg 16. The length of the prepreg 16 is set to 1143 mm.

In the prepregs 17 and 18, a reinforcing fiber F17 of the prepreg 17 and a reinforcing fiber F18 of the prepreg 18 form fibrous angle of +45° and −45° respectively with the axis of the shaft 1. The mandrel 10 is wound with six turns of each of the prepregs 17 and 18 at the tip side thereof. The length of each of the prepregs 17 and 18 is set to 300 mm.

The prepregs 17 and 18 are formed as an angular reinforcing layer at the tip side of the mandrel and has a tensile breaking strain of 1.7%. A butt-side end 17*a* of the prepreg 17 and a butt-side end 18*a* of the prepreg 18 are both disposed at the butt side of the mandrel 10 with respect to the boundary position P2 disposed at the boundary between the steeply tapered part 10B and the gently tapered part 10C. The distance from the boundary position P2 to the butt-side end 17*a* of the prepreg 17 as well as the butt-side end 18*a* of the prepreg 18 is 100 mm which is about 8.7% of the whole length of the shaft 1.

The shaft 1 is produced by a sheet winding manufacturing method. The prepregs 11 through 18 are wound sequentially (prepregs 11→12→ . . . 18) around the mandrel 10 from the inner layer side thereof to the outer layer side thereof. After the laminate of the prepregs 11 through 18 is lapped with a tape made of polypropylene, integral molding is performed by heating the laminate lapped with the tape in an oven at a certain pressure to harden the resin. Thereafter the mandrel 10 is drawn from the laminate. In this manner, the shaft 1 is formed. As the reinforcing fibers F11 through F18 of the prepregs 11 through 18, carbon fiber is used. As the matrix resin of the prepregs 11 through 18, epoxy resin is used.

As described above, the prepregs 11 through 16 are layered ne upon another on the mandrel 10 having the steeply tapered art 10B formed at its tip side, and the prepregs 17 and 18 of the tip-side angular reinforcing layer are disposed at an optimum position of the mandrel 10. Therefore the shaft 1 is allowed to be lightweight, realize a low torque, and have such a high strength that the shaft 1 is not broken.

A golf club shaft according to a second embodiment of the present invention will be described below.

Figure 4:
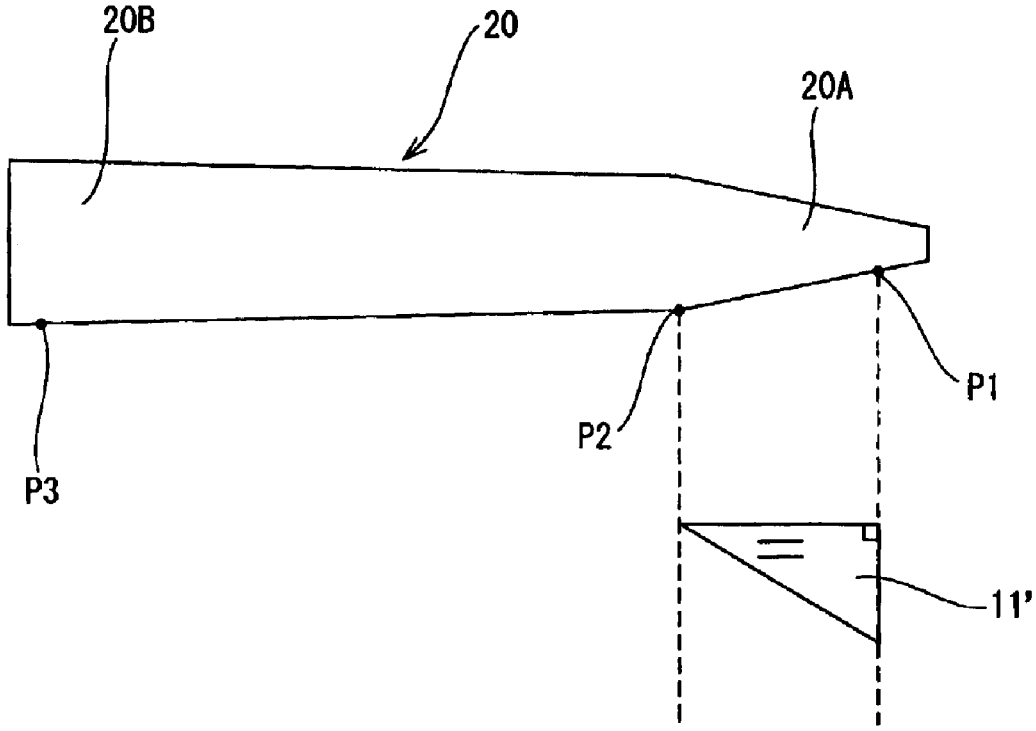
FIG. 4 shows a mandrel of a second embodiment.

As shown in FIG. 4, a mandrel 20 to be used to produce the shaft according to the second embodiment of the present invention has a steeply tapered part 20A disposed at the tip side of the shaft 1 and having a steep tapering ratio of 16.5/1000 in the axial direction of the shaft 1; and a gently tapered part 20B continuous with the steeply tapered part 20A and having a gentle tapering ratio of 8/1000 in the axial direction thereof. The diameter of the mandrel 20 at a position P1 corresponding to the tip 1*a* of the shaft 1 is set to 4.4 mm. The diameter of the mandrel 20 at a position P2 disposed at the boundary between the steeply tapered part 20A and the gently tapered part 20B is set to 7.7 mm. The diameter of the mandrel 20 at a position P3 corresponding to the butt 1*b* of the shaft 1 is set to 14.2 mm.

The steeply tapered part 20A extends in a length of 200 mm from the position P1 corresponding to the tip 1*a* of the shaft 1. The gently tapered part 20B extends from the butt-side termination of the steeply tapered part 20A to the position P3 corresponding to the butt 1*b* of the shaft 1. The distance from the position P2 disposed at the boundary between the steeply tapered part 20A and the gently tapered part 20B to the position P1 corresponding to the tip 1*a* of the shaft 1 is 200 mm which is about 17.5% of the whole length of the shaft 1. The shaft 1 is produced by winding the same prepregs 11 through 18 as those of the first embodiment around the mandrel 20 in the same manner as that of the first embodiment. In the second embodiment, the configuration of the prepreg 11 of the first embodiment is altered to that of a prepreg 11' (length: 200 mm, the mandrel 20 is wound with five turns of the prepreg 11') in conformity to the configuration of the mandrel 20, as shown in FIG. 4.

Golf club shafts of examples 1 through 5 of the present invention and those of comparison examples 1 through 3 are described below. As shown in table 1, the configuration of the mandrel and the specification of the prepreg of the tip-side angular reinforcing layer were appropriately set. The shafts had the same length, the same outer diameter at the tip thereof, the same outer diameter at the butt thereof, and the same thickness at the butt thereof. In any of the shafts, carbon fibers were used as the reinforcing fiber of the prepreg, and epoxy resin was used as the matrix resin of the prepreg.

The basic layering construction of the prepreg of each of the examples 1 through 5 and the comparison examples 1 through 3 was similar to that of the prepreg of the example 1. However, each of the examples 1 through 5 and the comparison examples 1 through 3 was varied from that of the example 1, as described below. There was a variation in the number of turns of the prepregs 11, 17, and 18 disposed at the tip side of the mandrel. Table 2 shows the material for each of the prepregs 11 through 18.

TABLE 1

| | Shaft | | | | | Mandrel | | | | | | | |
|---|---|---|---|---|---|---|---|---|---|---|---|---|---|
| | | | | Shaft diameter | | Mandrel diameter | | Tip-side gently tapered part | | Steeply tapered part | Gently tapered part | Boundary position | |
| | Length Mm | Weight g | Torque deg | Tip ϕ mm | Butt ϕ mm | Tip ϕ mm | Butt ϕ mm | Tapering ratio | Length mm | Tapering ratio | Tapering ratio | Distance from tip mm | Diameter ϕ mm |
| E 1 | 1143 | 51 | 4.0 | 9.0 | 15.7 | 4.4 | 14.2 | 8/1000 | 100 | 25/1000 | 8/1000 | 200 | 7.7 |
| E 2 | 1143 | 55 | 3.8 | 9.0 | 15.7 | 4.4 | 14.2 | 8/1000 | 100 | 25/1000 | 8/1000 | 200 | 7.7 |
| E 3 | 1143 | 51 | 4.3 | 9.0 | 15.7 | 4.4 | 14.2 | 8/1000 | 100 | 25/1000 | 8/1000 | 200 | 7.7 |
| E 4 | 1143 | 56 | 3.7 | 9.0 | 15.7 | 4.9 | 14.2 | 8/1000 | 200 | 16/1000 | 8/1000 | 350 | 8.9 |
| E 5 | 1143 | 51 | 3.7 | 9.0 | 15.7 | 4.4 | 14.2 | 8/1000 | 100 | 25/1000 | 8/1000 | 200 | 7.7 |
| CE 1 | 1143 | 49 | 4.2 | 9.0 | 15.7 | 4.4 | 14.2 | 8/1000 | 100 | 25/1000 | 8/1000 | 200 | 7.7 |
| CE 2 | 1143 | 61 | 3.6 | 9.0 | 15.7 | 4.4 | 14.2 | 8/1000 | 100 | 25/1000 | 8/1000 | 200 | 7.7 |
| CE 3 | 1143 | 48 | 4.7 | 9.0 | 15.7 | 5.7 | 14.2 | 8/1000 | 100 | 12/1000 | 8/1000 | 200 | 7.7 |

| | Tip-side angular reinforcing layer | | | |
|---|---|---|---|---|
| | Fibrous angle deg | Deviation from boundary position mm | Tensile breaking strain % | Durability |
| E 1 | 45 | 100 | 1.7 | ◎ |
| E 2 | 45 | 300 | 1.7 | ◎ |
| E 3 | 20 | 300 | 1.7 | ○ |
| E 4 | 45 | 100 | 1.7 | ◎ |
| E 5 | 45 | 100 | 0.8 | ○ |
| CE 1 | 45 | 30 | 1.7 | Δ |
| CE 2 | 45 | 500 | 1.7 | ◎ |
| CE 3 | 45 | 100 | 1.7 | X |

where "CE" denotes comparison example.
where "E" denotes example.

TABLE 2

| Example Comparison example | | Kind of fiber | Tensile modulus of elasticity GPA | Density | Tensile strength MPa | Tensile breaking strain % | Content of resin % | Name of company |
|---|---|---|---|---|---|---|---|---|
| Common | Prepreg 11 | T700S | 230 | 1.8 | 4900 | 1.8 | 25 | Toray Industries, Inc. |
| Common | Prepreg 12, 13 | M40J | 377 | 1.77 | 4410 | 1.1 | 25 | Toray Industries, Inc. |
| Common | Prepreg 14 | M30S | 294 | 1.73 | 5490 | 1.6 | 25 | Toray Industries, Inc. |
| Common | Prepreg 15 | M30S | 294 | 1.73 | 5490 | 1.6 | 25 | Toray Industries, Inc. |
| Common | Prepreg 16 | M30S | 294 | 1.73 | 5490 | 1.6 | 25 | Toray Industries, Inc. |
| Other than example 5 | Prepreg 17, 18 | T700S | 230 | 1.8 | 4900 | 1.8 | 25 | Toray Industries, Inc. |
| Example 5 | Prepreg 17, 18 | M46J | 436 | 1.84 | 4210 | 0.8 | 25 | Toray Industries, Inc. |

where "CE" denotes comparison example.
where "E" denotes example.

EXAMPLE 1

A golf club shaft was prepared by using a mandrel and prepregs similar to those of the first embodiment and a method similar to that of the first embodiment.

EXAMPLE 2

The butt-side end of each prepreg of the tip-side angular reinforcing layer was disposed at the butt side of the mandrel with respect to the boundary position between the steeply tapered part and the gently tapered part. The distance from the butt-side end of the prepreg to the boundary position, namely, the deviation of the butt-side end of the prepreg with respect to the boundary position-was set to 300 mm which is about 26.2% of the whole length of the shaft. The shaft was made by carrying out a method similar to that of the example 1 except that the number of turns of the tip-side prepreg was varied from that of the example 1.

EXAMPLE 3

The fibrous angle of reinforcing fibers of the prepreg of the angular reinforcing layer disposed at the tip side of the mandrel was set to 20 degrees. The shaft was made in a method similar to that of the example 2 except that the number of turns of the prepreg was varied from that of the example 2.

EXAMPLE 4

Figure 5:
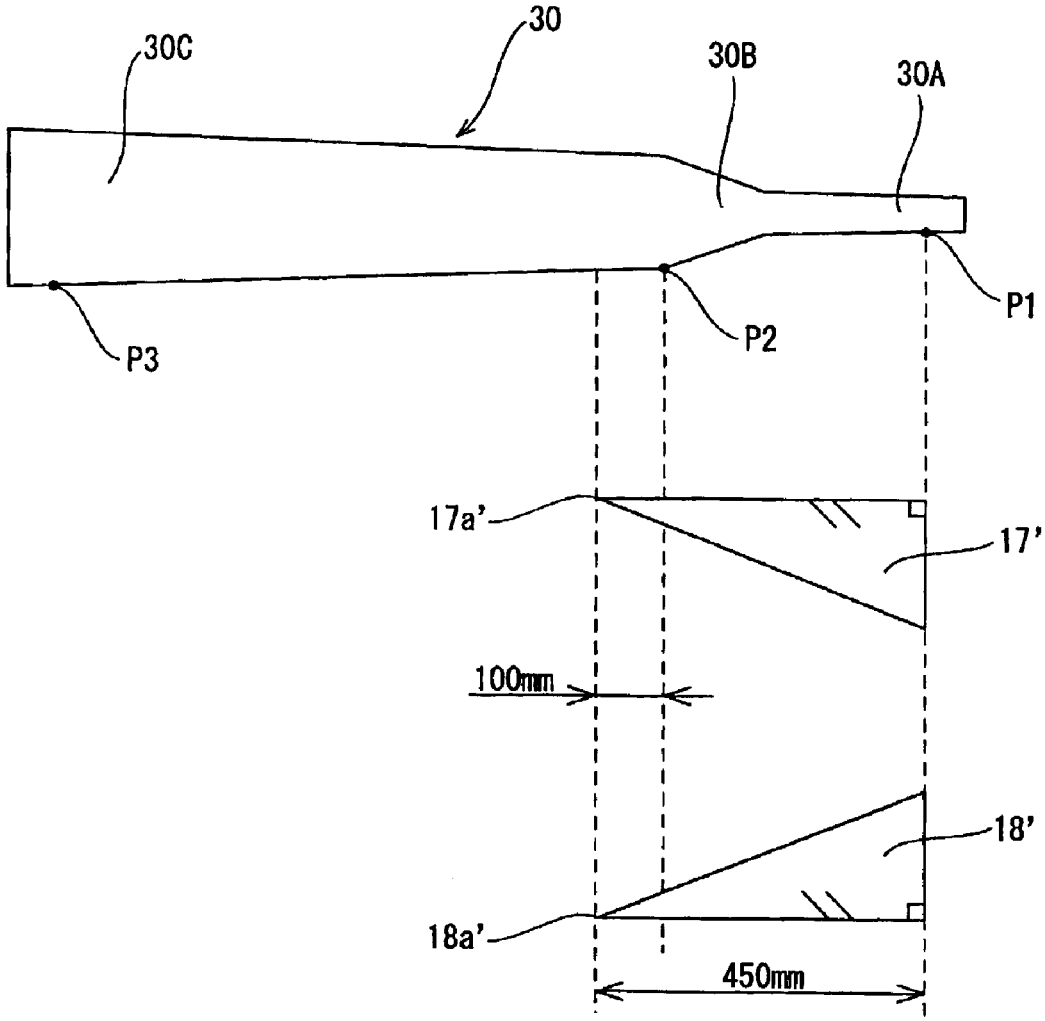
FIG. 5 shows the relationship between a mandrel of an example 4 and prepregs of an angular reinforcing layer at a tip side.

A mandrel 30 shown in FIG. 5 was used. Table 1 shows numerical values set on items of the mandrel 30.

The tip-side gently tapered part 30A of the mandrel 30 extended in a length of 200 mm from the position P1 corresponding to the tip 1*a* of the shaft 1. The steeply tapered part 30B extended in a length of 150 mm from the butt-side termination of the tip-side gently tapered part 30A. The gently tapered part 30C extended from the butt-side termination of the steeply tapered part 30B to the position P3 corresponding to the butt 1*b* of the shaft 1. The distance from the position P2 disposed at the boundary between the steeply tapered part 30B and the gently tapered part 30C to the position P1 corresponding to the tip 1*a* of the shaft 1 was 350 mm which was about 30.6% of the whole length of the shaft 1.

In correspondence to the alteration of the configuration of the mandrel, the length of each of prepregs 17' and 18' of the tip-side angular reinforcing layer was set to 450 mm. The distance from the butt-side ends 17*a*' and 18*a*' of the prepregs 17' and 18' to the boundary position P2 was set to 100 mm which was about 8.7% of the whole length of the shaft.

EXAMPLE 5

The tensile breaking strain of the prepreg of the tip-side angular reinforcing layer was set to 0.8%. The shaft was made in a method similar to that of the example 1 except that the number of turns of the tip-side prepreg was varied from that of the example 1.

COMPARISON EXAMPLE 1

The butt-side end of each prepreg of the tip-side angular reinforcing layer was disposed at the butt side of the mandrel with respect to the boundary position between the steeply tapered part and the gently tapered part. The distance from the butt-side end of the prepreg to the boundary position was set to 30 mm which is about 2.6% of the whole length of the shaft. That is, there was a small deviation of the butt-side end of the prepreg with respect to the boundary position. The shaft was made by carrying out a method similar to that of the example 1 except that the number of turns of the tip-side prepreg was varied from that of the example 1.

COMPARISON EXAMPLE 2

The butt-side end of each prepreg of the tip-side angular reinforcing layer was disposed at the butt side of the mandrel with respect to the boundary position between the steeply tapered part and the gently tapered part. The distance from the butt-side end of the prepreg to the boundary position was set to 500 mm which was about 43.7% of the whole length of the shaft. That is, there was a large deviation of the butt-side end of the prepreg with respect to the boundary position. The shaft was made by carrying out a method similar to that of the example 1 except that the number of turns of the tip-side prepreg was varied from that of the example 1. The weight of the shaft was 61 g.

COMPARISON EXAMPLE 3

The tapering ratio of the steeply tapered part was set to 12/1000 to make the inclination thereof a little smaller. The shaft was made by carrying out a method similar to that of the example 1 except that the number of turns of the tip-side prepreg was varied from that of the example 1.

Measurement of the torque and evaluation of durability of the golf club shafts of the examples 1 through 5 and the comparison examples 1 through 3 were conducted by using a method which will be described later. Table 1 shows results of the evaluation.

Method of Measuring Torque

Figure 6:
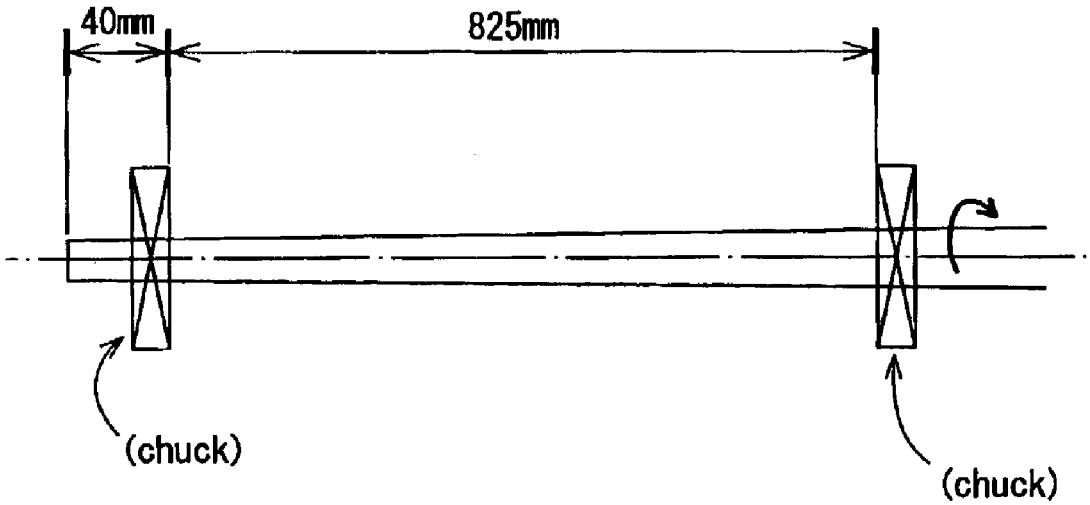
FIG. 6 shows a method of measuring a torque.

As shown in FIG. 6, to measure the torque (degree), a twist angle of each shaft was measured by applying a torque of 136.3N·cm (13.9 kgf·cm) to a point spaced at 865 mm from the tip of the shaft at its head side, with a portion in the range of the tip thereof to a position spaced at 40 mm from the tip thereof fixed.

Durability Test

A swing test was conducted to evaluate the durability of the shaft of each of the examples and the comparison examples. Using a swing robot (shot robot III) manufactured by Miyamae Kabushiki Kaisha, golf balls were hit at a head speed of 50 m/s with golf clubs each having the head-installed shaft of each of the examples and the comparison examples. The hitting point was spaced at 10 mm upward from a point spaced 30 mm from the club face enter toward the heel. The shafts that were not broken when hey hit golf balls at 3000 times were marked with ◎. The hafts that were broken when they hit golf balls at 2000–3000 times were marked with ○. The shafts that were broken when they hit golf balls at 1000–2000 times were marked with Δ. The shafts that were broken when they hit golf balls at 1–1000 times were marked with X.

As shown in table 1, the mandrel used in the examples 1 through 5 had the steeply tapered part formed at the tip side of the mandrel and the gently tapered part at the butt side thereof, and the tip-side angular reinforcing layer was disposed at an optimum position in consideration of the relationship between the mandrel and the tip-side angular reinforcing layer. Therefore the shaft is allowed to be lightweight, realize a low torque, and have such a high strength that it is not broken.

Since in the shaft of the comparison example 1, the butt-side end of the prepreg of the tip-side angular reinforcing layer was deviated in a short distance with respect to the boundary position between the steeply tapered part and the gently tapered part, a stress concentrated on the boundary position. Thus the shaft had a low durability. In the shaft of the comparison example 2, the butt-side end of the prepreg of the tip-side angular reinforcing layer was deviated in a long distance with respect to the boundary position. Thus to maintain the durability at the boundary position and realize a low torque, it is necessary to increase the layering amount of the prepreg. Thus it was impossible to make the shaft lightweight. Since the steeply tapered part was not formed on the mandrel of the comparison example 3, the shaft was thin at its tip side. Therefore the shaft had a low durability.

As apparent from the foregoing description, according to the present invention, by using the mandrel having the steep inclined part having a high tapering ratio formed at the tip side thereof, appropriately disposing the tapered parts on the mandrel, and appropriately disposing the prepregs of the angular layers at the tip side of the mandrel, it is possible to efficiently increase the thickness of the tip side of the golf club shaft to which a largest load is applied when a golf ball is hit and efficiently suppress twisting of the most twistable tip side of the shaft. Therefore it is possible to provide the golf club shaft having a light weight to lengthen the flight distance of the hit golf ball, a low torque to stabilize the direction of the hit golf ball, and further such a high strength that it is not broken.

What is claimed is:

1. A golf club shaft formed by winding prepregs of an angular layer and prepregs of a straight layer around a mandrel having a steeply tapered part formed at a tip side thereof and a gently tapered part formed at a butt side thereof, wherein at least one of said prepregs of said angular layer is disposed at said tip side as an angular reinforcing layer, a butt-side end of said prepreg of said angular reinforcing layer at said tip side is disposed at a butt side of a boundary between said steeply tapered part and said gently tapered part; and a distance from said butt-side end of said prepreg of said angular reinforcing layer at said tip side to said boundary position is not less than 5% nor more than 30% of a whole length of said shaft.

2. The golf club shaft according to claim 1, wherein a tapering ratio of said steeply tapered part is not less than 15/1000 nor more than 35/1000; and a tapering ratio of said gently tapered part is not less than 6/1000 nor more than 10/1000.

3. The golf club shaft according to claim 2, wherein a distance from said boundary position between said steeply tapered part and said gently tapered part to a position corresponding to a tip of said shaft is not less than 10% of said whole length of said shaft nor more than 25% thereof.

4. The golf club shaft according to claim 2, wherein a fibrous angle of reinforcing fibers of said prepregs of said angular reinforcing layer disposed at said tip side of said mandrel is set to not less than 20 degrees nor more than 70 degrees.

5. The golf club shaft according to claim 2, wherein a tensile breaking strain of said prepregs of said angular reinforcing layer disposed at said tip side of said mandrel is set to not less than 1.0%.

6. The golf club shaft according to claim 1, wherein a distance from said boundary position between said steeply tapered part and said gently tapered part to a position corresponding to a tip of said shaft is not less than 10% of said whole length of said shaft nor more than 25% thereof.

7. The golf club shaft according to claim 6, wherein a fibrous angle of reinforcing fibers of said prepregs of said angular reinforcing layer disposed at said tip side of said mandrel is set to not less than 20 degrees nor more than 70 degrees.

8. The golf club shaft according to claim 6, wherein a tensile breaking strain of said prepregs of said angular reinforcing layer disposed at said tip side of said mandrel is set to not less than 1.0%.

9. The golf club shaft according to claim 1, wherein a fibrous angle of reinforcing fibers of said prepregs of said angular reinforcing layer disposed at said tip side of said mandrel is set to not less than 20 degrees nor more than 70 degrees.

10. The golf club shaft according to claim 1, wherein a tensile breaking strain of said prepregs of said angular reinforcing layer disposed at said tip side of said mandrel is set to not less than 1.0%.

11. The golf club shaft according to claim 1, formed by using a mandrel having a gently tapered part on a tip end with a tapering ratio lower than that of said steeply tapered part formed on a tip side of the golf club shaft.

* * * * *